United States Patent [19]

Clanet

[11] Patent Number: 4,589,452

[45] Date of Patent: May 20, 1986

[54] METHOD AND DEVICE FOR FILLING AN AEROSOL CAN WITH TWO COMPARTMENTS

[76] Inventor: Frank Clanet, 4 bis, Sentier des Voisinoux, 92190 Meudon-Bellevue, France

[21] Appl. No.: 677,075

[22] Filed: Nov. 30, 1984

[30] Foreign Application Priority Data

Dec. 1, 1983 [FR] France ..... 83 19239

[51] Int. Cl.[4] ..... B65B 3/04

[52] U.S. Cl. ..... 141/3; 141/20; 141/326

[58] Field of Search ..... 141/3, 20, 19, 18, 329, 141/330, 325, 326, 327

[56] References Cited

U.S. PATENT DOCUMENTS 4,328,843 5/1982 Fujii ..... 141/3

*Primary Examiner*—Houston S. Bell, Jr.

*Attorney, Agent, or Firm*—Burns, Doane, Swecker & Mathis

[57] ABSTRACT

A method and apparatus for filling aerosol cans having two compartments separated by a flexible or mobile partition. Most of the air contained in a first compartment is removed before a substance to be packaged is introduced. The substance is introduced by a metering device without coming into contact with the atmosphere, either before or after a valve has been fitted. In the latter case, the valve is opened and the substance passed through it.

18 Claims, 3 Drawing Figures

METHOD AND DEVICE FOR FILLING AN AEROSOL CAN WITH TWO COMPARTMENTS

BACKGROUND OF THE INVENTION

1. Field of the Invention

The present invention relates to a method and apparatus for filling aerosol cans of the so-called "pressure-barrier" type. These cans are formed from a rigid receptacle having an interior with two compartments separated by a mobile or deformable partition, one of the compartments being designed to contain a liquid or pasty substance to be packaged and the other a pressurized propellent gas or liquid which is thus prevented from coming into contact with the substance to be packaged.

2. Description of the Prior Art

Conventionally, the mobile or deformable partition consists of a pocket which is made either of a flexible plastic material, such as low-density polyethylene, or of high-grade coated aluminum. This pocket has a single opening. The diameter of this opening may be substantially the same as that of the opening of the receptacle and, in this case, the pocket is designed so as to be held in the crimping which fixes the sealing valve is onto the receptacle, or the diameter of the opening is approximately the same as that of the receptacle and, in this case, the pocket is designed so as to be held in the crimping of a flange which forms the lid and onto which the valve is crimped.

Conventionally, filling is performed as follows:

- the pocket is placed inside the receptacle and filled with the substance to be packaged,
- the receptacle is sealed by crimping either the valve or the flange carrying the valve,
- a propellent medium is introduced into the other compartment in the can by means of a hole which is provided in the bottom of the can and sealed by an impermeable rubber stopper through which a hollow needle is passed in order to perform filling.

In another system, the mobile or deformable partition consists of a piston which moves inside the can, sealing means being provided between this piston and the internal walls of the can. The filling method is the same as that described above. Hereinafter, the term "deformable partition" will also embrace a mobile partition of this type.

Another system has recently been proposed (Aerosol Report, Svitila et al, volume 23, No. 6/84, pages 286–299) from lecture given September, 1983, in which the propellent medium is formed in a sealed pocket which contains metered amounts of two solid or liquid chemical products which, when brought into contact with each other, release a certain amount of gas. Initially, the desired amount of substance to be packaged is introduced into the receptacle, then the pocket containing the gas-generating products and a small quantity of gas already present is introduced into it and, finally, crimping of the valve or of the flange carrying the valve is performed. During use, the pocket expands owing to the action of the small quantity of gas which it contains, and this expansion leads to gradual opening of the partitions separating the gas-generating products with the result that most of the propellent gas is formed during use.

These methods have the drawback that the substance to be packaged is filled either in the open air or inside a controlled-atmosphere enclosure which is necessarily large and, hence, costly if contamination by oxygen or by microbial germs is to be eliminated.

On the other hand, even if this operation is performed in a sterile atmosphere, the substance to be packaged can be modified, when it comes into contact with this atmosphere, by dissolution of the gas of the protective atmosphere, or by removal out of the volatile matter which is dispersed through the large area of the controlled-atmosphere enclosure.

OBJECTS AND SUMMARY OF THE INVENTION

An object of the invention is to provide a method for filling such cans in conditions where they are protected from the atmosphere and where there is no change in the substance to be packaged, even when fragile; this method being simple in concept and implementation and hence inexpensive.

Another object of the invention is to provide a device for implementing such a method.

The present invention provides a method for filling an aerosol can provided with a valve and comprising two compartments separated by a flexible or mobile partition. The substance to be packaged is introduced into a first compartment whereupon, this compartment is closed and a propellent fluid is introduced into the second compartment or produced therein. Of importance is the fact that most of the air in the first compartment is removed before introduction of the substance to be packaged. The substance to be packaged is introduced into the first compartment by means of a metering device without coming into contact with the atmosphere whereupon said first compartment is sealed. The expression "most of the air" means that at least 95% of the latter and preferably at least 98% thereof is removed from said first compartment.

According to a preferred embodiment, when the material to be packaged is of low viscosity, such as an aqueous liquid for example, the valve of the can is affixed before introducing the substance to be package, whereupon said substance is introduced into the first compartment via said valve.

In the case where the material to be packaged is viscous, such as a glue or a paint, the valve may be fitted after the substance has been introduced, so as to seal said first compartment. This of course involves additional apparatus.

In both cases, in order to remove the air from the first compartment, a vacuum is applied to the latter at an extent sufficient to enable a certain volume of substance to be introduced in said first compartment without modifying the vacuum. Advantageously, in order to maintain the desired volume in said first compartment, a vacuum is created in the second compartment. This method is suitable more particularly, but not exclusively, for the filling of a can where the partition separating the two compartments consists of a deformable sheet made of metal or plastic. Should the propellent gas be produced in a gradual manner, when the substance have to be used, inside a deformable pocket constituting the second compartment and is introduced into the can before the latter would be closed, it is preferable to introduce a deformable pocket which has been vacuum-sealed into the first compartment from which the air has been removed before introducing the substance wherein.

According to another embodiment wherein use is made of a can provided with a mobile partition separating the two compartments, for example, a piston, in order to remove the air from the first compartment, the volume of the latter may be reduced by displacing said mobile partition whereupon the substance is introduced into the first compartment while increasing the volume of the latter.

The metering device advantageously comprises a metering container which may be connected to the first compartment by means of a distribution valve and, according to a simple embodiment which is applicable to substances of low viscosity, the metering container is placed above the aerosol can. The substance is then passed from the metering container into the first compartment by means of gravity. According to another embodiment suitable for substances of any viscosity, the metering device comprises at least one metering pump.

When the propellent fluid is not generated inside a deformable pocket according to the method mentioned above, it is known to provide, in the wall of the second compartment, for example, at the bottom of the can, an orifice provided with a plug made of elastic material.

According to a simple method of implementation, the second compartment is evacuated and/or filled by means of a hollow needle, such as a hypodermic needle, which is intended to be passed through said stopper.

If high operating speeds are required and, in particular, if the substance to be packaged is of high viscosity, said plug is inserted only after evacuation and final filling of the second compartment have been performed.

The present invention also provides an apparatus intended to embody the method described above.

Said apparatus includes means for filling an aerosol can having two compartments separated by a flexible or mobile partition. Means are provided for keeping the can in an upright filling position with the opening of a first compartment of the said can facing upwards. Means are provided for pouring a measured amount of substance to be packaged into said first compartment, for fixing a valve for discharging the said substance, onto said opening of the first compartment, and for introducing a propellent fluid into a second compartment of said can or for generating a propellant fluid therein. Said device is also provided with means for removing most of the air contained in the first compartment before introduction of the substance, and means for protecting said substance from any contact with air during its introduction and during fixing of the valve.

According to an embodiment which allows filling through the valve, the apparatus includes a metering container, a valve and a connecting pipe. Means for displacing vertically the can provided with the valve are provided so as to obtain a sealed connection between the valve and the connecting pipe. Means capable of opening the valve without interrupting the said sealed connection, means for connecting the metering container to a vacuum source, and means for introducing said substance into the metering container are further provided.

According to another embodiment which allows filling before the valve is fitted, the apparatus comprises a first assembly including a first pipe which can form a sealed connection with the first compartment, a second pipe connected to a vacuum source, a metering pump capable of delivering the required amount of substance and a valve capable of connecting the first pipe either to the second pipe or to the output of the metering pump. A second assembly intended to affix the valve of the receptacle onto the body of the latter without causing the interior of the first compartment to come into contact with the atmosphere. Means is provided for linking, in succession, the first assembly and the second assembly to the body of an aerosol can without causing the first compartment of the latter to come into contact with the atmosphere during the corresponding relative movement. In this case, the device may comprise, in addition, a third assembly for introducing a deformable pocket, intended to form the second compartment, inside the aerosol can, and means capable of linking the said aerosol can to the said third assembly before linking it to said first assembly.

When use is not made of a pocket, according to a peculiar embodiment which, however, does not permit high speeds, the device may comprise, in addition, a hollow needle of the hypodermic type, means for introducing the end of the needle into the second compartment, and means for connecting the interior of the needle separately to a vacuum source and to a propellent-fluid source.

According to another embodiment which obviates this drawback, the apparatus comprises, in addition, a chamber capable of forming a sealed connection with the second compartment through a hole in the wall of the can, this enclosure being provided with means for keeping a said plug separated from the hole and for placing the stopper in the hole, and means for forming a connection with a vacuum source and a propellent-fluid source.

BRIEF DESCRIPTION OF THE DRAWINGS

The invention will now be described in more detail by means of exemplary embodiments illustrated in the drawings in which.

DESCRIPTION OF PREFERRED EMBODIMENT

Figure 1:
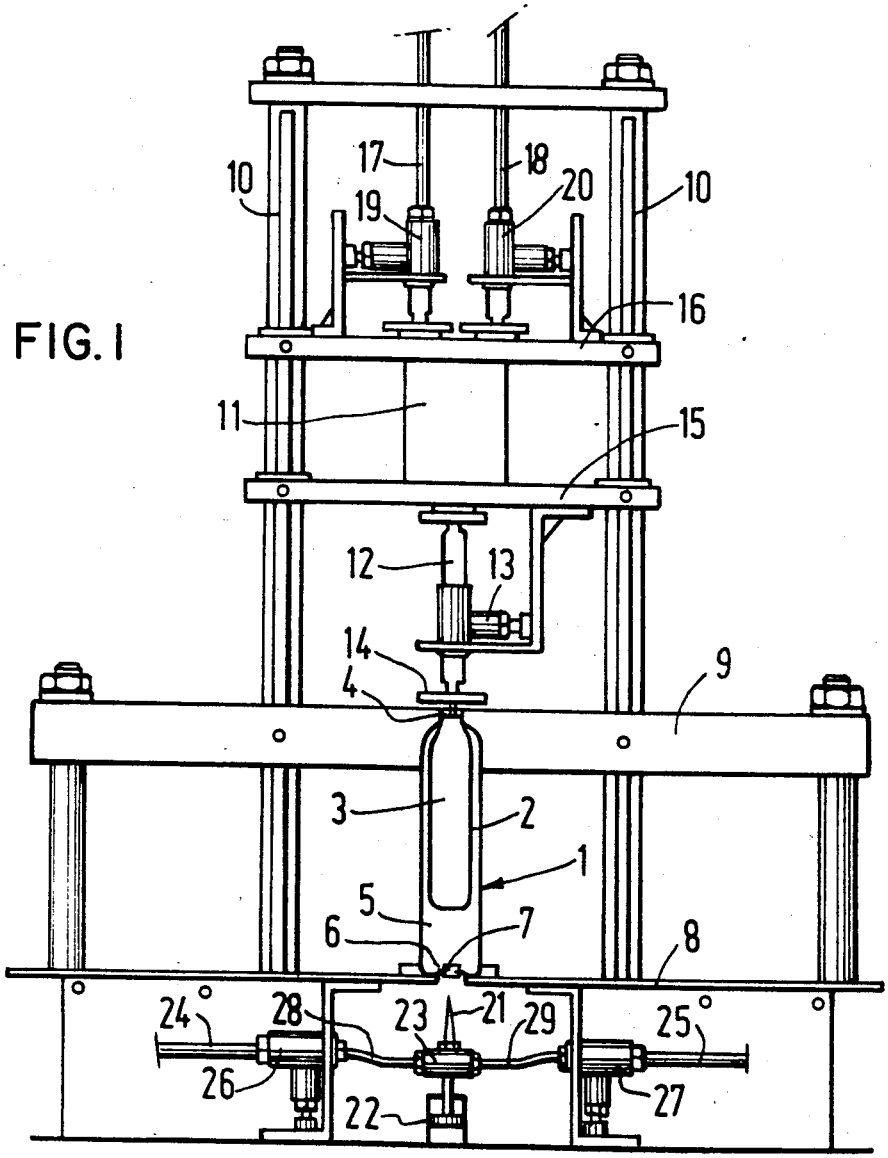
FIG. 1 is a diagrammatic view, in elevation and partial cross-section, of a filling device according to the invention.

In FIG. 1, an aerosol receptacle 1 is shown in cross-section with an internal partition 2 which is made of aluminum and divides the internal space into two compartments. A first compartment 3 is connected to a valve 4, which is of the conventional type, and a second compartment 5 is shown which surrounds the first compartment over practically its entire periphery and which can be filled with propellent gas, under pressure or liquid, through a hole 6 provided in the bottom of the receptacle and sealed by a plug 7 made of neoprene rubber or similar material.

The receptacle 1 is placed on a support 8 which forms part of the filling apparatus and is held at the top by a crosspiece 9 provided with clamping collars or stirrups (not shown) and integral with the support 8. Vertical slides 10 also integral with the support 8 support the means for filling the first compartment 3. These filling means comprise a premetering container 11, the volume of which corresponds to that of the compartment 3. Several interchangable premetering containers of different volumes may be provided so that different receptacles 1 can be filled. The premetering container is located above the receptacle 1 and is substantially centered on the axis of the latter. A pipe 12, provided with a solenoid valve 13, is situated at the bottom of the container 11. The pipe is provided, at the bottom, with a seal 14 for connection to the valve 4. Instead of solenoid valve 13, and other solenoid valves described hereinafter, use may be made of a manually operated valve or of a valve operated pneumatically, mechanically, or in some other fashion.

The pipe 12 and the solenoid valve 13 are carried by a crosspiece 15 which is connected to the bottom of the container 11. Crosspiece 15 is able to slide along slides 10 between a bottom position where the seal 14 ensures a connection between the pipe 12 and the compartment 3, by means of the valve 4, and a top position (not shown) where the pipe 12 is separated from the receptacle 1. In said bottom position, provisions are made for means, not shown in the drawings, for example a pushbutton, to the valve 4 in an open position, such means allowing the valve to close again when the crosspiece 15 moves away from said bottom position.

Another crosspiece 16, similar to the crosspiece 15, is connected to the top of the container 11. It has mounted on it two pipes 17, 18, the first of which is connected to a vacuum source and the second of which is connected to a means for supplying the liquid to be introduced into the compartment 3. These two pipes are each provided with a solenoid valve 19, 20 and are connected to container 11 at the top thereof.

In addition to the pipes 17, 18, other pipes may be arranged in the same manner or purpose to feed other substances, such as additives or cleaning or sterilizing products, into the container.

The means for filling the compartment 5 are located at the bottom of the apparatus, underneath the support 8. The filling means includes a hollow needle 21 of the hypodermic type, which is arranged vertically and is able to move, as a result of the action of a jack 22, from a lower position where it is at rest to a higher position where it passes through the plug 7. In this high position, the compartment 5 communicates with the inside channel of the needle 21. This channel is connected, by means of a T-connection 23, to two pipes 24, 25 which are connected, respectively, to a vacuum source and to a supply of propellent gas or liquid, such as nitrogen. Each pipe 24 and 25 is provided with a solenoid valve 26, 27. Flexible tubes 28, 29 are provided between the T-connection 23 and the solenoid valves 26, 27 so as to allow movement of the T-connection 23 which acts as a support for needle 21.

Operation of the filling device can be controlled either manually or automatically. Operation includes the following steps:

(a) positioning of the receptacle 1 provided with its valve 4,
(b) lowering of crosspieces 15, 16 until a sealed connection is achieved at the height of joint 14 and opening of valve 4,
(c) raising of needle 21 until it passes through plug 7,
(d) generation of a vacuum in the compartments 5 and 3 and in the container 11 by opening solenoid valves 26, 13 and 19,
(e) closing of solenoid valves 13 and 19 so as to separate the container 11 and compartment 3 from each other, leaving them under vacuum and isolated from the external atmosphere,
(f) opening of solenoid valve 20 and filling of the container 11,
(g) closing of solenoid valve 20,
(h) opening of solenoid valve 13 and transfer of the liquid from the container 11 into the compartment 3,
(i) closing of solenoid valve 13 and raising of crosspieces 15 and 16, resulting in closure of the valve 4,
(j) closing of solenoid valve 26 and then opening of said solenoid valve 27 so as to introduce the propellent gas or liquid into the compartment 5,
(k) closing of solenoid valve 27 and lowering of needle 21 until it reaches its rest position,
(l) removal of the filled receptacle 1.

Thus the liquid introduced into the compartment 3 is not in contact with the atmosphere. These are the only risks of contamination outside of the receptacle 1 in the region of section of the pipe 12 located below the solenoid valve 13 and the point 14. Therefore, very small amounts are involved and these can be easily sterilized, if necessary, for example, by means of germicide radiation.

In another embodiment, support 8 is able to move along the slides 10 and, when stage (b) is reached, it is raised together with the receptacle 1, the crosspieces 15, 16 being fixed. The process, moreover, is the same as that just described. An advantage of this solution, compared to the preceding one is that pipes 17, 18 supplying the container 11 and any additional pipes can be provided so that they are rigid, the crosspiece 16 being linked to the slides 10. The position of the crosspiece 15 can be adjusted so that containers 11 of varying height can be accommodated.

Figure 2:
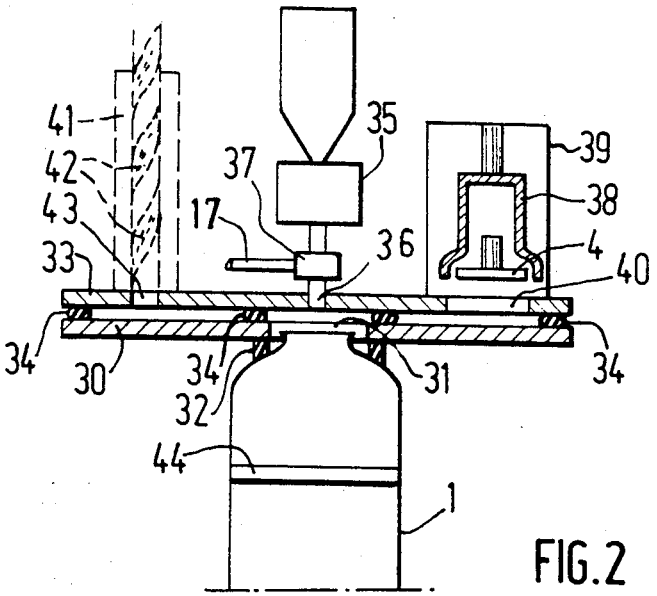
FIGS. 2 and 3, respectively partial views showing alternative embodiments of the device.

FIG. 2 relates to a variation of the apparatus shown in FIG. 1, this variation corresponding to filling of the receptacle before the valve is fitted. Only the top of the receptacle 1 is shown, together with the elements located in the vicinity. The parts which are similar to those shown in FIG. 1 have the same reference numbers. A first horizontal plate 30 has a window 31 surrounded by a seal 32 which rests on the top of the receptacle 1 around the opening intended to receive the valve 4. A second plate 33 is located above first plate and is able to slide on it. Seals 34 are located between the two plates. On the plate 33 are mounted a few assemblies; a filling assembly comprises a metering pump 35 which is connected to an orifice 36 passing through plate 33, by means of a three-way valve 37 connected to a vacuum pipe 17. A sealing assembly comprises means 38 of the known type for positioning and crimping a valve 4. This assembly is surrounded by a sealed bell jar 39 in which a vacuum can be created and communicates with a window 40 in the plate 33. Optionally, the plate 33 may be provide with a a third assembly 41 mounted thereon and including a device for dispensing flexible pockets 42 containing a product which generates pressurized fluid, in the case where this method is used. This assembly causes the pockets 42 to pass one by one through an orifice 43 in the plate 33.

When plates 30 and 33 are moving relative to each other, the receptacle 1 is brought, in succession, under the orifice 43 if it is used, under the orifice 35 and under the window 39, whereupon the receptacle can be removed. If the method involving flexible pockets is not used, the second compartment is able to receive the propellent fluid after crimping of the valve, and the fitted receptacle is then removed.

FIG. 2 shows the assemblies aligned so that the plates are able to move in linear fashion relative to each other. The plates may also be circular and rotated about a vertical axis.

FIG. 2 shows a piston 44 separating the two compartments in the receptacle. It is obvious that this piston may be replaced by a flexible partition or removed if the method involving flexible pockets is used.

Figure 3:
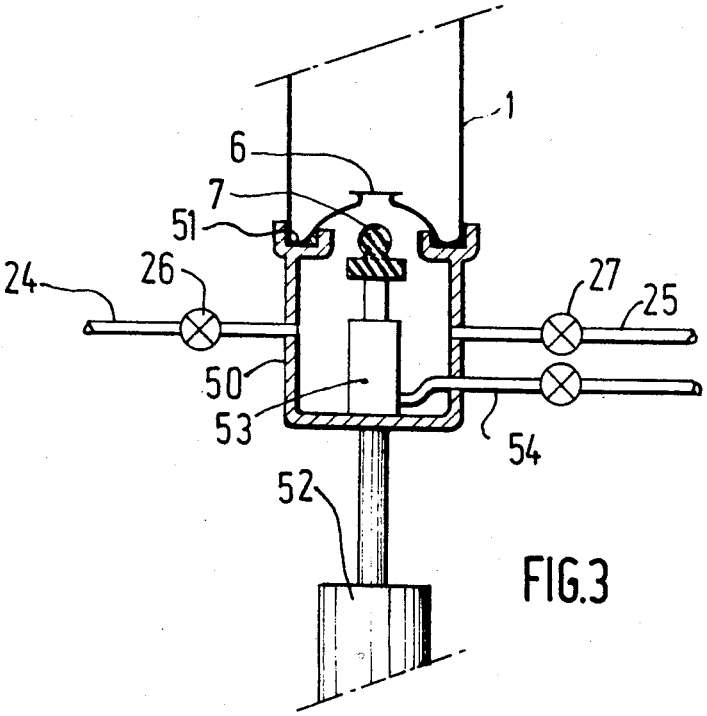

FIG. 3 relates to an alternative embodiment of the apparatus shown in FIG. 1, relative to the filling of the second compartment. In said Figure the bottom portion of the receptacle 1 is shown, together with the neighboring elements.

A bell jar 50 rests against receptacle 1 and is pressed against the edge of the bottom of the said receptacle by means of a first jack 52, a seal 51 being inserted between the said bell jar and receptacle. Inside the bell jar 50, a second jack 53 bears a plug 7 made of elastic material. This plug is kept separated from the hole 6 provided in the bottom of the receptacle, in the position shown in FIG. 3. At the end of operation, plug 7 is inserted by means of jacks 53 into hole 6. The bell jar 50 is connected, by means of two pipes 24, 25 each provided with a solenoid valve 26, 27, to a vacuum source and a propellent-fluid source, respectively. The pipe 54 supplying the jack 53 passes through the wall of the bell jar 50 in a sealed manner.

The invention is designed for many applications in relation with products which must not be in contact with the ambient atmosphere, in particular for packaging various drinks and other alimentary products, intended either for consumption or for analysis. It could also be used for applications in the sectors of medicine, biology, cosmetology, etc., or for the packaging of products which must avoid contact with air, such as paints, resins, adhesives, etc. In the embodiments of the invention which describe the filling of viscous materials, it is apparent that such embodiments can also be used for the filling of powdered or particulate material.

What is claimed is:

1. A method for filling an aerosol can of the type having first and second compartments separated by a flexible or mobile partition and having a valve connected to said first compartment, comprising the steps of:

providing a metering device for metering a substance to be packaged in said can;

removing the air in said first compartment;

moving the substance from said metering device to said first compartment in a manner such that said substance does not come into contact with the atmosphere;

sealing said first compartment; and introducing a propellant means into said second compartment.

2. A method as claimed in claim 1, and further comprising the step of:

permanently affixing said valve to said first compartment prior to moving said substance into said first compartment.

3. A method as claimed in claim 1, and further comprising the step of:

affixing said valve to said first compartment subsequent to moving said substance into said first compartment.

4. A method as claimed in claim 1, and further comprising the steps of:

maintaining the volume of said first compartment equal to a volume of the substance moved therein; and wherein the air is removed from said first compartment by the creation of a vacuum and wherein said substance is moved into said first compartment without interrupting the vacuum.

5. A method as claimed in claim 4, and further comprising the step of:

creating a vacuum in said second compartment so that the volume in the first compartment is maintained at a desired quantity.

6. A method as claimed in claim 1, and further comprising the steps of:

displacing said flexible or mobile partition to remove air from said first compartment; and wherein the volume of the first compartment is increased as the substance is moved into said first compartment.

7. A method as claimed in claim 4, and further comprising the steps of:

providing a deformable pocket for said propellant means;

vacuum sealing said deformable pocket; and introducing said deformable pocket into said can before said can is closed.

8. A method as claimed in claim 1, and further comprising the steps of:

providing a container for said metering device; and providing a distribution valve between said container and said first compartment.

9. A method as claimed in claim 8, wherein said substance is of low viscosity, and further comprising the steps of:

situating said container above said aerosol can; and passing said substance from said container to said first compartment by means of gravity.

10. A method as claimed in claim 1, and further comprising the step of:

providing at least one metering pump for said metering device.

11. A method as claimed in claim 1, and further comprising the steps of:

providing an orifice in a wall of said second compartment;

inserting a stopper of elastic material in said orifice;

inserting a hollow needle of the hypodermic type through said stopper; and whereby said propellant means is introduced into said second compartment through said hollow needle.

12. A method as claimed in claim 1, and further comprising the steps of:

providing an orifice in a wall of said second compartment;

evacuating air from said second compartment prior to introducing said propellant means; and inserting a stopper of elastic material into said orifice subsequent to introducing said propellant means into said second compartment.

13. An system for filling an aerosol can, comprising:

a can having first and second compartments;

a flexible or mobile partition separating said first and second compartments;

means for keeping said can in a filling position with an opening of said first compartment of the can facing upwards;

means for transferring a measured quantity of the substance to be packaged into the first compartment;

means for fixing a valve for discharging the substance onto the opening of the first compartment, and means for introducing a propellent means into a second compartment of the can;

means for removing most of the air contained in the first compartment before introduction of the substance; and means for protecting the substance from any contact with the air during the transferring of said measured quantity and during fixing of the valve.

14. An system as claimed in claim 13, and further comprising:

an arrangement including a metering container, a distribution valve and a connecting pipe;

means for moving vertically the can provided with the valve so as to obtain a sealed connection between the valve and the connecting pipe;

means for opening the valve without interrupting the sealed connection;

means for connecting the metering container to a vacuum source; and wherein said means for transferring a measured quantity includes means for introducing the substance into the metering container.

15. An system as claimed in claim 13, and further comprising:

a first assembly including a first pipe capable of forming a sealed connection with the first compartment;

a second pipe connected to a vacuum source;

a metering pump capable of delivering the required amount of substance and a valve means for connecting the first pipe either to the second pipe or to the output of the metering pump;

a second assembly for positioning and fixing the valve of the receptacle onto the body of the latter without causing the interior of the first compartment to come into contact with the atmosphere; and means for linking, in succession, the first assembly and the second assembly to the body of an aerosol can without causing the first compartment of the latter to come into contact with the atmosphere during a corresponding relative movement.

16. An system as claimed in claim 15, and further comprising:

a third assembly for introducing a deformable pocket to form the second compartment, inside the aerosol can; and means for linking the aerosol can to the third assembly before linking it to the first assembly.

17. An system as claimed in claim 13, and further comprising:

a hollow needle of the hypodermic type;

means for introducing the end of the needle into the second compartment; and means for connecting the interior of the needle between a vacuum source and a propellent-fluid source.

18. An system as claimed in claim 13, and further comprising:

a chamber for forming a sealed connection with the second compartment through a hole in the wall of the can;

said chamber being provided with means for keeping a stopper separated from the hole and for inserting the stopper in the hole; and means for providing a connection of said chamber to a vacuum source and to a propellent-fluid source.

* * * * *